United States Patent [19]

Holz, Sr. et al.

[11] 4,046,484

[45] Sept. 6, 1977

[54] SPACED-ROTOR RIDE-TYPE SURFACE WORKING MACHINE WITH SINGLE-STICK CONTROL OF ALL MOVEMENTS

[75] Inventors: Orville H. Holz, Sr., Palm Harbor; Norbert J. Holz, Spring Hill, both of Fla.

[73] Assignee: Orville H. Holz, Jr., Roselle, Ill. ; a part interest

[21] Appl. No.: 741,610

[22] Filed: Nov. 15, 1976

[51] Int. Cl.[2] ..... E01C 19/22

[52] U.S. Cl. ..... 404/112; 51/177

[58] Field of Search ..... 404/112; 51/177

[56] References Cited

U.S. PATENT DOCUMENTS

| | | | |
|---|---|---|---|
| 2,869,442 | 1/1959 | Mincher | 51/177 X |
| 2,887,934 | 5/1959 | Whiteman | 404/112 |
| 2,898,826 | 8/1959 | Livermont | 404/112 |
| 3,124,911 | 3/1964 | Vinella | 51/177 |
| 3,232,189 | 2/1966 | Young | 404/112 |
| 3,936,212 | 2/1976 | Holz | 404/112 |

*Primary Examiner*—Nile C. Byers
*Attorney, Agent, or Firm*—Darbo, Robertson & Vandenburgh

[57] ABSTRACT

In a surface-working machine, as for troweling fresh concrete, the operator rides on a frame which is carried by surface-working rotors, each having evenly spaced tools or trowels. The application of tilting forces to the working rotors to cause movement of the total machine forwardly or rearwardly or to either side, or turning, or any combination thereof, is controlled by the operator through a single control stick, with all movements of the control stick corresponding to the machine movement desired. If, in a troweling machine, there are only two rotors, their trowels intermesh to work overlapping circles, and no gap is left between the working circles when movement is perpendicular to a "biaxial" plane (common to both rotational axes). This gives maximum width of coverage, and the operator's seat faces in that direction of movement. Application of the required tilting forces to both rotors is achieved while nevertheless providing frame stability by providing, for one rotor assembly, only a single pivot disposed to make that assembly rigid with the frame except as to tilting the rotor axis in the biaxial plane. The operator's seat and engine are both approximately centered in the biaxial plane so that no unbalanced forces result from different weights of operators. The main frame serves to shield the rotors.

10 Claims, 11 Drawing Figures

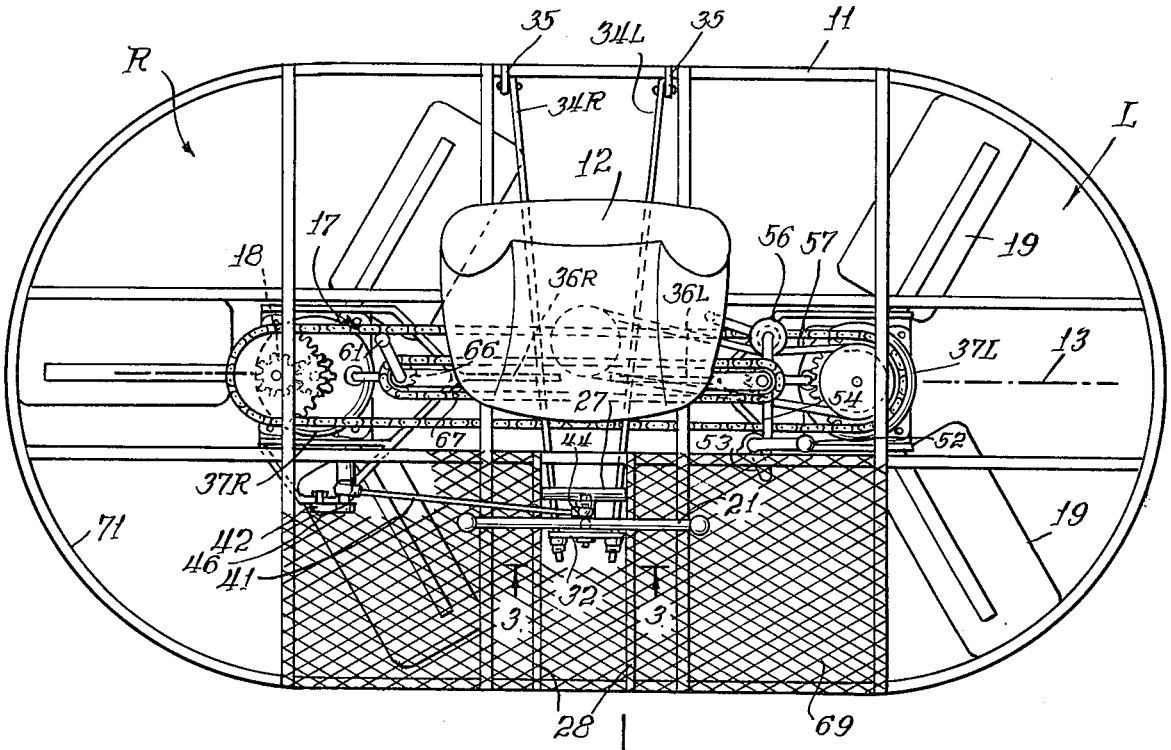
Fig. 1.
Fig. 2.
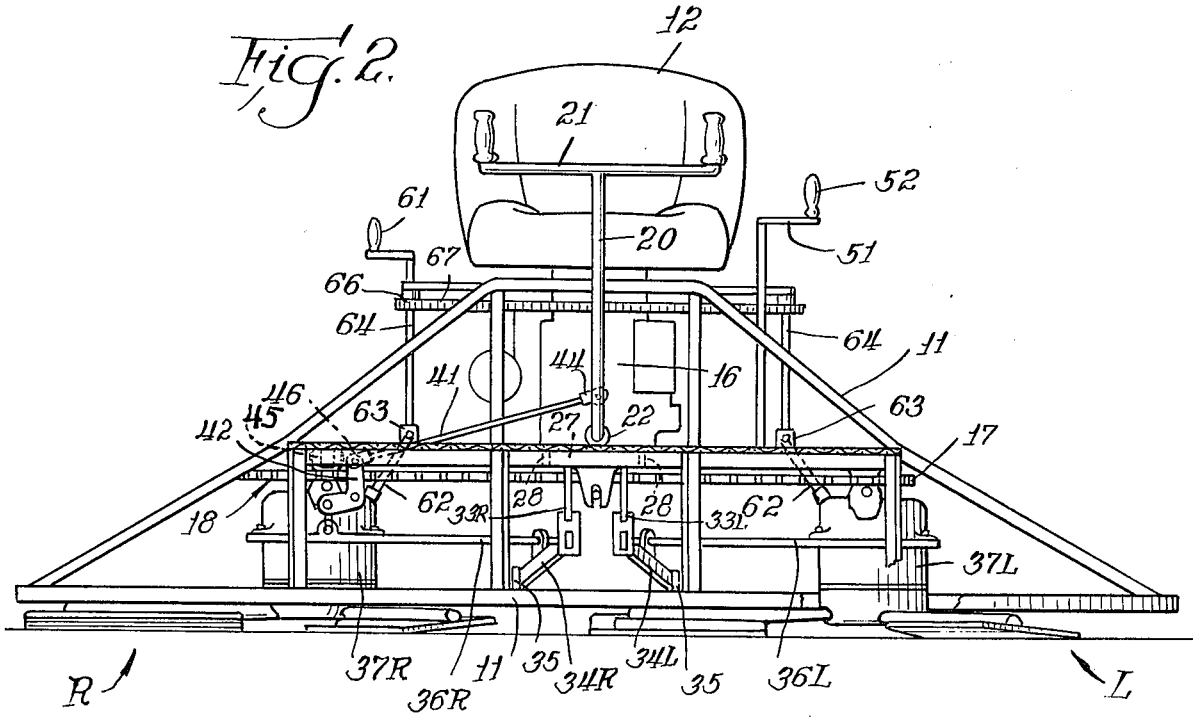

SPACED-ROTOR RIDE-TYPE SURFACE WORKING MACHINE WITH SINGLE-STICK CONTROL OF ALL MOVEMENTS

INTRODUCTION

The invention of which the present disclosure is offered for public dissemination in the event that adequate patent protection is available relates to ride-type surface-working machines such as machines for troweling freshly laid concrete. The present invention is an improvement over U.S. Pat. No. 3,936,212 issued to the same inventors.

In some of its aspects, the present invention relates especially to the two-rotor machine, the prior patent having disclosed both two-rotor and three-rotor machines. In other aspects, the present invention relates to simplified controls, regardless of the number of rotors.

The two-rotor machine as disclosed in the prior patent had two main faults, both of which are cured by the present invention. One fault was that with movement in the broadside direction (perpendicular to the biaxial plane) there would be a gap between the two troweled bands. In practice, it was usually possible to avoid this gap by having the machine move at an angle sufficiently different from the true broadside direction so that one rotor would lead the other rotor by enough to cause overlap of their two paths. However, this necessitated some special maneuvering at the end of a run to allow the trailing rotor to catch up with the lead rotor, and to work all areas nevertheless. According to the present invention, this problem with the prior two-rotor machine is overcome by having the rotor circles overlap slightly, the troweling blades of one rotor extending slightly into the arcuate gaps between the troweling blades of the other rotor. The machine can then be made to move in the true broadside direction without leaving any untroweled gap between the two paths of its rotors. Indeed, the operator's seat is placed facing in this direction as it is the intended normal direction of movement. Although intermeshed rotors are not new, they are not believed to have been used previously in a ride-type machine to allow the operator's seat to face broadside.

The stability of the frame and of the rider's seat is made quite satisfactory, according to the present invention, by making the frame transversely rigid with the bearing block of one rotor, transversely of the biaxial plane (the plane common to the two rotor axes). In other words, although one rotor has a universal mounting with respect to the frame, the other rotor is connected to the frame with a single pivotal axis extending transversely of the biaxial plane. The reason for previously using two universal mountings of the rotor bearing blocks to the frame was so that the tilting forces by which the machine is made to propel itself could be applied to any rotor at any point. It might seem that with a single pivot this would no longer be possible. However, this aspect of the present invention makes use of the fact that with a two-rotor machine, if a frame is transversely rigid with respect to one rotor, then applying a tilting force transversely between the frame and the other rotor sets up a reaction force which necessarily applies approximately the same tilting force to the opposite side of the other rotor. This is so because there is no way the frame can resist such a tilting force except by applying a tilting pressure to the rotor with respect to which it is transversely rigid. Tilting forces applied between the frame and the universally mounted rotor in line with the length of the frame are not similarly reflected by a tilting force on the other rotor, because lengthwise of the biaxial plane the frame has great stability independently of the tilting forces. Giving the transversely rigid rotor a pivotal connection on a transverse axis permits the application of a tilting force (in the biaxial plane) between it and the frame. A previous proposal for a ride-type machine, using rotors rotating about a common axis, may have achieved fair stability in keeping the frame upright, but one of its rotors could not be tilted with respect to the frame, and an outer rotor of relatively large diameter would have had various disadvantages, if it had ever been commercial.

With the machines of U.S. Pat. No. 3,936,212, most of the movements were desirably controlled by a single control stick, but for some movements pedal action was also required. According to the present invention, the need for such pedal action is avoided, and all movements of the machine are controlled by moving the single control stick with the same type of movement that the operator desires the machine to take. Thus, the stick is moved forwardly for the machine to move forwardly, and rearwardly for the machine to move rearwardly, to one side for the machine to move in that direction without turning, to the other side for the machine to move in that direction without turning, and twisted about its axis in either direction for the machine to swing in that direction. The control stick is provided with a handlebar extending transversely across its top (or it could be a steering wheel) to aid in this twisting control. The control stick is mounted with three pivotal axes, and linkages for accomplishing the movements mentioned are all independent of components of the control stick movements other than the one pivotal movement for which they are provided. However, any mixed movement of the machine is readily achieved, still by a stick movement resembling the desired machine movement.

The advantages of the invention may be understood more fully from the following description and from the drawings.

DESIGNATION OF FIGURES

FIG. 1 is a view looking down on the machine.

FIG. 2 is a view of the machine from the front, which is the lower side in FIG. 1.

Figure 3:
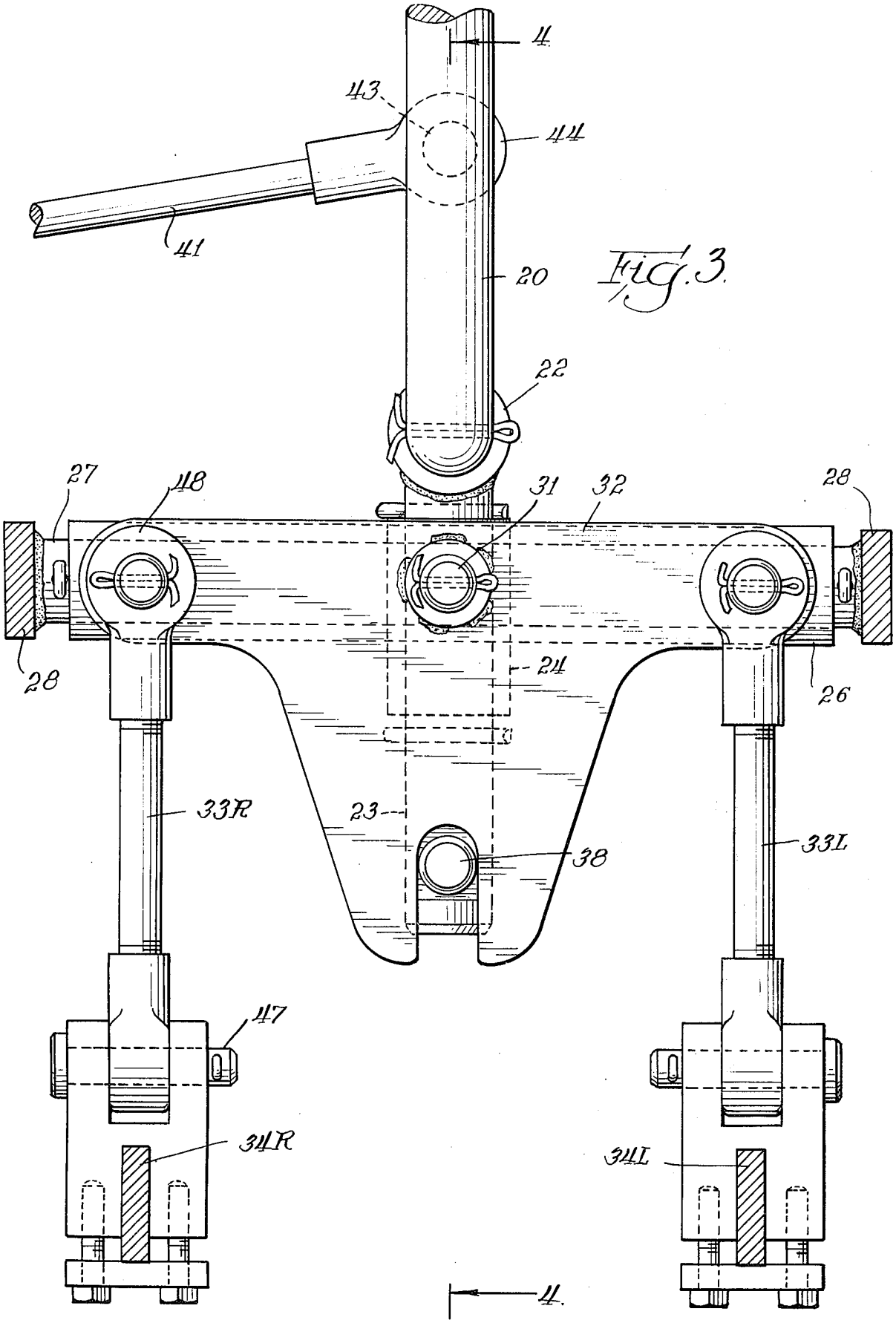
FIG. 3 is an enlarged fragmentary detail view of the control stick mounting, and connections, as viewed from the front; and is indicated by the line 3—3 of FIG. 1.

FIGS. 6 through 11 are diagrammatic indications of the different basic movements of the machine which can be achieved by the single control stick movements, the arrows within each rotor circle indicating not only the rotor's direction of rotation but also the point at which increased downward pressure is applied by movement of the control stick corresponding to the indicated movement of the machine.

In various figures, some parts have been omitted for clarity of parts shown.

GENERAL DESCRIPTION

Although the following disclosure offered for public dissemination is detailed to ensure adequacy and aid understanding, this is not intended to prejudice that purpose of a patent which is to cover each new inventive concept therein no matter how others may later disguise it by variations in form or additions or further improvements. The claims at the end hereof are intended as the chief aid toward this purpose, as it is these that meet the requirement of pointing out the parts, improvements, or combinations in which the inventive concepts are found.

As seen in FIGS. 1 and 2, the illustrated form of the invention includes a frame 11 which supports an operator's seat 12 and is in turn carried by the pair of rotors or rotor assemblies R and L. The rotor assemblies are driven by an engine 16, carried by the frame 11. The rotors R and L are driven in opposite directions, as by illustrated chain 17 and reversal drive 18 for one rotor. Each rotor includes a set (illustrated as 3) of troweling blades 19. The two rotors are close enough together so that their circles of action overlap as seen in FIGS. 6 through 11, with the blades of each rotor penetrating the action circle of the other rotor. The rotors have a constant phase relationship such that the blades may be said to intermesh. Thus, as each blade swings through the vertical biaxial plane 13 (the plane in which the rotational axes for rotors R and L are both located), its tip will be spaced about equally from the nearest blades of the other rotor.

As taught in the said prior U.S. Pat. No. 3,936,212, a troweling machine of this type, or other surface working machine, can be made to propel itself with any desired movement by selectively applying tilting forces to the rotors. When a tilting force is applied to a rotor, it increases the pressure of the rotor on the supporting surface (the concrete being troweled) at one side of the rotor while reducing the pressure at the opposite side. The increased pressure provides increased driving traction, enabling the rotor to propel the machine in the direction that this traction is effective. Movements of a wide variety are attainable by different choices of pressure points.

Figure 7:
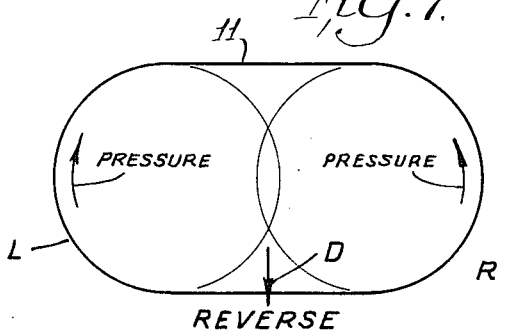
Figure 8:
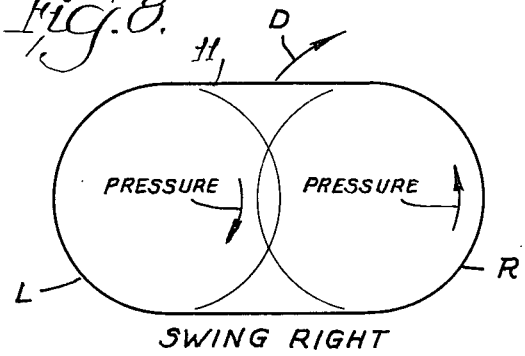
Figure 9:
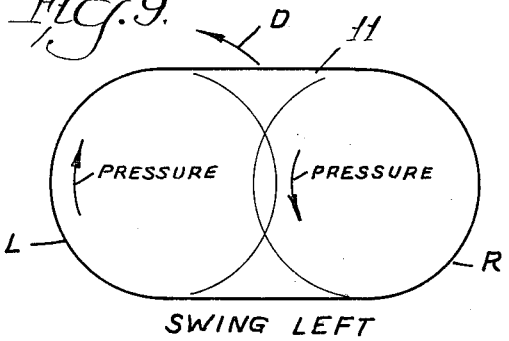
Figure 10:
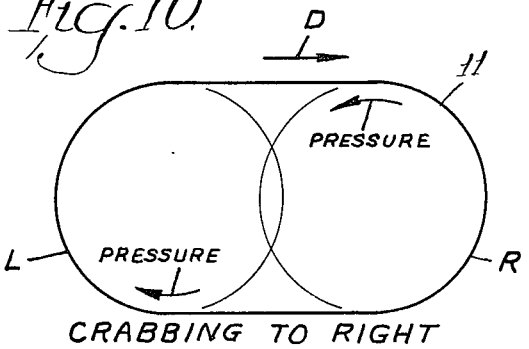
Figure 11:
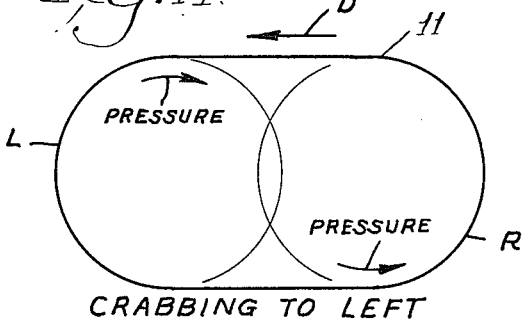

The basic movements are shown in FIGS. 6 through 11, although in fact combinations or vectors of these movements can be obtained. For each movement, the arrows indicating direction of rotation of each rotor are located at the sides of the rotor where the increased pressure against the concrete being troweled is assumed. Thus, in FIG. 6, with the increased pressure applied in the overlapping zones, where the rotor rotation moves the trowels rearwardly, the increased reaction or traction will move the machine forwardly. As seen in FIG. 7, when the increased pressure is applied to the opposite sides of the rotors, where the trowels are moved forwardly by rotor rotation, the increased traction or reaction will cause reverse movement of the machine. In FIG. 8, where pressure is indicated as being increased at the right side of both rotors, the right-hand rotor R will, by traction reaction, move that portion of the machine rearwardly while the left-hand rotor L will, by reaction, move that portion of the machine forwardly, this traction-couple causing the machine to swing or turn to the right with little or no other movement. With opposite effect, illustrated in FIG. 9, pressure at the left side of each rotor will cause the machine to swing to the left. In FIG. 10, pressure at the rear of rotor L and at the front of rotor R tends in both instances to drive the machine by reactive traction to the right in a "crabbing" action (without turning). In FIG. 11, the opposite effect causes the machine to crab to the left.

SIMPLIFIED CONTROL SYSTEM

According to the present invention, all applications of tilting forces to the rotors to give them selectively increased pressures are applied by single control stick 20, preferably equipped with some sort of a torque member such as transversely extending horizontal handlebar 21. As seen best in FIG. 4, the L-shaped control stick 20 is pivoted about a forwardly extending axis by sleeve 22, which is carried by vertical shaft 23 pivoted about a vertical axis in a sleeve 24. The sleeve 24, in turn, is carried by a sleeve 26 which pivots on a tube 27 for pivotal action about a horizontal axis extending in a right-to-left direction, parallel to the biaxial plane. As seen best in FIG. 3, the tube 27 is secured, as by welding, to sub-frame members 28 (which are a rigid part of frame 11).

Figure 4:
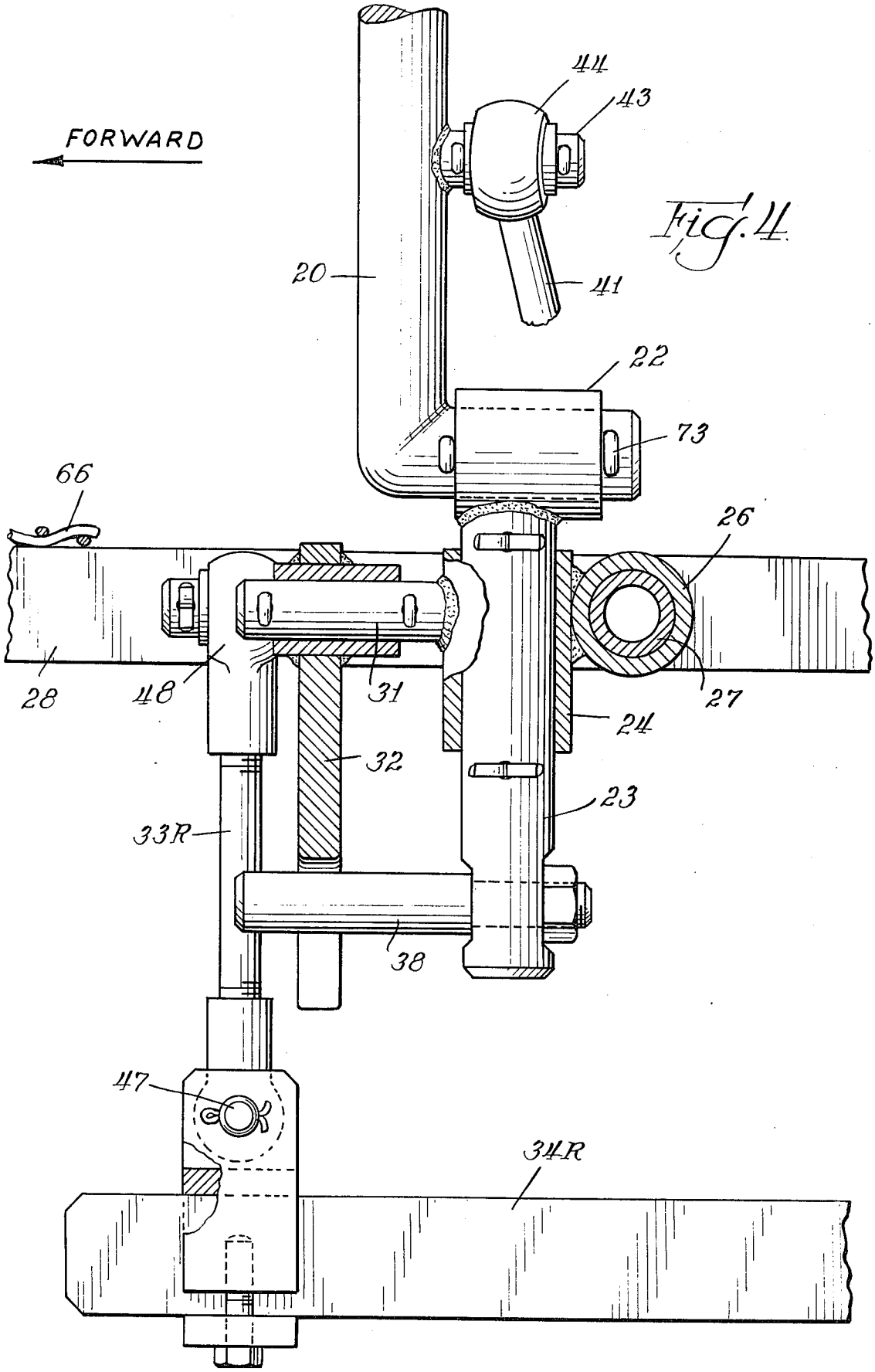
FIG. 4 is a view largely in vertical section of the structure shown in FIG. 3, taken approximately along the line 4—4 of FIG. 3.
Figure 5:
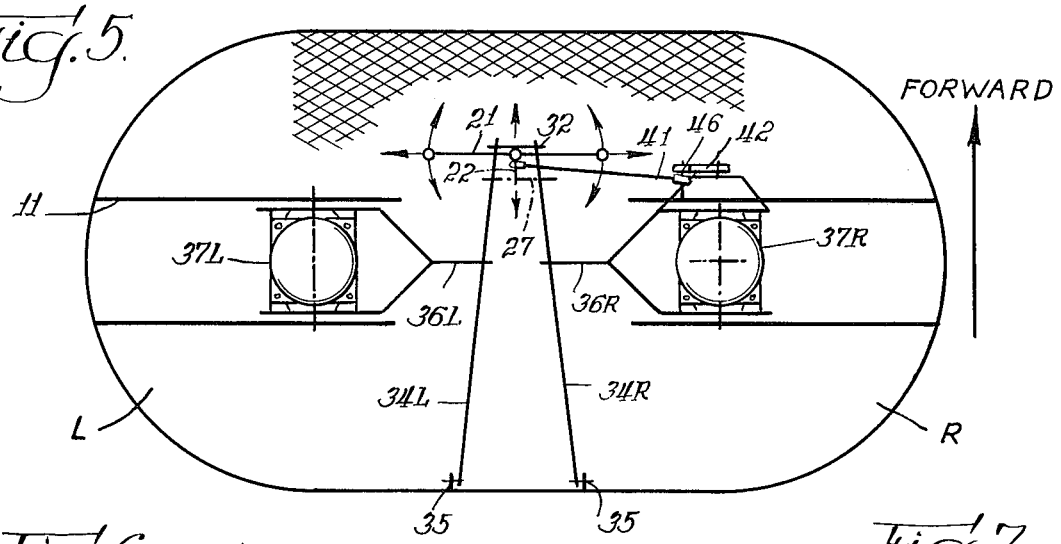
FIG. 5 is a diagrammatic illustration of the control linkages for applying propelling pressures to different points of the two rotors, the front being at the top in this view.
Figure 6:
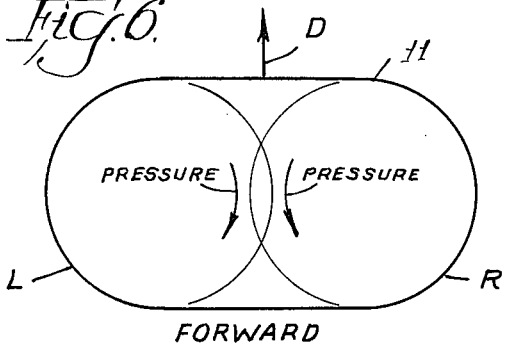

For forward self-propulsion of the machine, the control stick 20 is tilted forwardly, which is to the left in FIG. 4. As seen in FIG. 4, this causes a rocking of the control stick assembly about the cross tube 27, so that its forwardly extending pin 31 swings downwardly. This lowers the rocker plate 32 (without rocking it about pin 31 at this time). The lowering of rocker plate 32, which is of T-shape as seen in FIG. 3, lowers links 33L and 33R, which in turn thrust downwardly their respective levers 34L and 34R. As seen best in FIG. 2, the lever 34R, which at its rear end is pivoted to a lug 35 on frame 11, engages yoke 36R, which in turn is so coupled to bearing housing 37R of rotor R that a tilting force is applied to the bearing housing 37R which increases the pressure of the blades on the concrete as they pass through the zone of overlap represented by the rotational arrow in FIG. 6. With lever 34L similarly tilted down and lowering the end of yoke 36L coupled to it to apply a tilting force to bearing housing 37L with a resultant increased pressure of the blades of the left rotor on the concrete as they pass through the overlap zone, the increased traction of both rotors in or centered on this overlap zone propels the machine forwardly.

Rearward movement is accomplished similarly except that everything is in the reverse sense. Thus, when the control stick 20 is pulled back by the operator, the rocking of the control assembly about the shaft 27 raises rocker plate 32, raising both of the levers 34R and 34L and raising the associated ends of yokes 36R and 36L, thereby applying increased pressure to the opposite sides of the left and right rotors where the blades are moving forwardly so that the traction they provide propels the machine in the reverse direction as indicated by FIG. 7.

To swing the machine to the right without other movement, the handlebar 21 is turned as would be a steering wheel, thereby twisting the control assembly about the vertical shaft 23 and swinging pin 38 to the right. This rocks the lower end of rocker plate 32 to the right. As seen in FIG. 3, when the lower end of rocker plate 32 is thus rocked toward cross link 33R about pin 31 (which is now stationary), it raises the link 33R and lowers the link 33L. As previously described with respect to forward movement, lowering the link 33L lowers lever 34L and its associated end of yoke 36L to apply increased pressure of the blades of the left-hand rotor as they pass through the overlap zone. As to the right-hand rotor, however, the situation is the same as for reverse movement in that raising link 33R and lever 34R and its associated end of yoke or tilt lever 36R tends to tilt the right-hand rotor outwardly so that its increased pressure is applied at the side thereof opposite the overlap area, where the blades are moving forwardly. Accordingly, the right-hand rotor has a rearwardly propelling effect while the left-hand rotor has a forwardly propelling effect and the result is a swing of the machine toward the right, as in FIG. 8.

If, however, the handlebar 21 is swung to the left, the rocker plate 32 is rocked in the opposite direction with the opposite effects as illustrated by the arrow placement in FIG. 9 and the machine swings to the left.

For making the machine crab to the right or left, moving sidewise without swinging, the control stick 20 is tilted to the right or left pivoting about its forwardly extending axis through sleeve 22. This does not move rocker plate 32 in any manner, and hence has none of the effects of that rocker plate movement which have been described. The only effect of tilting the control stick 20 is to pull or push the crab control link 41, connected to pin 43 on stick 20 by bearing 44. As seen best in FIG. 2, this link 41 pivots bell crank lever 42 to apply a raising or lowering force on the side of bearing housing 37R (or a tilt-lever rigid with it) seen in FIG. 2. This bearing housing 37R is universally pivoted to frame 11 not only about the pivotal axis for which yoke 36R operates, as previously described, but also by pivot through rocker 45 on an axis in a plane perpendicular to the other pivotal axis, and lying in the biaxial plane 13. Thus a rocker 45 is pivoted to the frame about an axis in the biaxial plane 13, and bearing housing 37R is pivoted to rocker 45 about an axis perpendicular to the biaxial plane 13. This permits crab link 41 to apply a rocking or tilting force to the bearing housing 37R in a direction to apply an increased traction force between the blades and the concrete, either at the forward point of the right rotor, as seen in FIG. 10, or at the rearward point of the right rotor R, as seen in FIG. 11. It might seem that with no crab control links, such as the link 41, extending toward the left rotor, the necessary tilting force for tilting it in the opposite direction, as indicated in FIGS. 10 and 11, and as is desired for good crabbing action, would not be achieved. But it is. As the bell crank lever 42 in FIG. 2 pulls upwardly on its side of bearing housing 37R, an equal reaction is a downward thrust on the immediately adjacent portion of frame 11. This is a tilting force applied to frame 11, and this force is in turn applied to bearing housing 37L because that bearing housing has no pivotal connection to the frame along an axis in biaxial plane 13. In short, the reaction to applying the tilting force to a right-hand rotor R for crabbing is applied through the frame to the left-hand rotor, for applying a substantially equal but opposite tilting force to the left rotor L. Because the rotors are of the same size, the opposite tilting forces may be expected to produce equal effects.

It will be observed that each of the control movements described leaves the others unaffected; although the control stick may be moved in ways which combine two or three of these movements. As already mentioned, swinging control stick 20 to the right or left does nothing except to shift crab link 41, inasmuch as, except for this, the control stick 20 merely pivots in sleeve 21, causing no movement thereof. If the control stick 20 is twisted to the right or to the left, this has no effect on crab link 41 because the connection of the crab link 41 with the control stick 20 is by means of a self-aligning bearing 44 centered (when stick 20 is vertical) on the extended axis of shaft 23. The spherical interface, conventional with such self-aligning bearings between the inner and outer parts, allows the inner part to pivot, as control stick 20 is pivoted, without causing any movement of the outer part. Although this pivotal action of control stick 20 rocks rocker plate 32 to produce the swinging movement of the machine described, it causes substantially no forward or rearward movement because position of pin 31 remains constant. When the control stick 20 is moved forwardly or rearwardly, this causes no rocking of the rocker plate 32, and hence no swinging of the machine; and it causes little or no longitudinal movement of the crab link 41. If the center point of self-aligning bearing 46 for connection (of the crab link 41 with the bell crank lever 42) is located on the extended axis of tube 27, the arcuate movement of self-aligning bearing 44 about said axis will not cause any movement of the bell crank lever 42.

All connections are constructed to give the freedom of movement required, without binding and with little or no backlash. For example, as seen at the bottom of FIG. 4, the combination of a snug connection represented by pin 47 and the self-centering bearing 48 at the top of link 33R provide all necessary freedom of movement so that the bottom of link 33R may be clamped rigidly to lever 34R, as shown. The pivoting of lever 34R about a fixed pivot (off to the right, as FIG. 4 is viewed; see lug 35 in FIG. 2) causes the pin 47 to follow an arcuate path, but this arcuate path is freely tolerated by the parts mentioned.

DRIVE CONTROL

It is desirable that something in the nature of a clutch be provided between the engine 16 and the rotors R and L. A simple way of accomplishing this is by a belt drive, with the belt too loose to perform its driving function except when tightened by a drive control device. In the illustrated form, the drive control device comprises a crank 51 with a handle 52, for operating a lever which cooperates with link 54 to form an over-center toggle mechanism for operating a tightener roller 56. when the handle 52 is swung to its released position, the roller 56 may recede, leaving the drive belt 57 too slack to transmit the driving force between engine 16 and rotor 14.

PITCH CONTROL FOR BLADES

Although not new with the present invention, there is preferably a single handle 61 for controlling the pitch adjustment for all of the blades 19 of both rotors. The conventional pitch control rod 62 of each rotor is connected through a universal joint 63 and shaft 64 to a sprocket 66 keyed on shaft 64, the two sprockets being coupled by chain 67.

FURTHER DETAILS

A grating 69 or other platform is preferably provided for the operator's feet, and for his passage to and from the operator's seat 12.

Conventional starting and lighting equipment (not shown) may be provided. The lighting may be advantageously mainly directed forwardly, as headlights, because most of the movement is expected to be in the forward direction.

Although a two-rotor machine has been illustrated, the simplified control system may readily be adapted to a three-rotor machine, the illustrated linkages being connected by additional linkages to the third rotor to apply tilting forces to it compatible with those applied to the two illustrated rotors, so that the third rotor will aid in the same movements provided by the two rotors. In a three-rotor machine of triangular nature, the three-point supports afford frame stability and all three rotors should be mounted to the frame through universal joints, and hence the effects of crab control link 41 should be extended to all three rotors, with proper variations to enable all three of them to cooperate in producing the crabbing movement.

Some economy of manufacture has been achieved in the illustrated form of the invention by constructing the machine frame with an outer oval bar 71 to serve also to guard the rotors as seen in FIGS. 1 and 2, instead of having a separate rotor guard for each rotor.

Assembly of the control stick combination has been made simple by the use of numerous cotter pins as at 73, for example. Some serve also as thrust bearings, the loads being light enough so that no great wear is expected. Bearing rings may be used where desired or found to be necessary.

Instead of rocking rocker plate 32 by a pin 38 in a slot in plate 32, bevel gear segments can be used, and are the present manufacturing choice. One on rocker plate 32, coaxial with stub shaft 31 would be driven by one carried by shaft 23 and turned by shaft 23 about the axis of shaft 23.

Gears and shafting may also be used for driving the rotors, instead of the illustrated belt and chain. However, even with drive shafts extending in both directions from the engine location, and driven oppositely so as not to need any reversing device at a rotor, the most convenient clutch action may be by a drive belt at the engine location.

ACHIEVEMENTS

According to one aspect of the invention, an exceedingly simple and stable ride-type surface-working machine such as a concrete troweling machine has been provided. The simplicity is achieved in part by recognizing that with a two-rotor machine the frame itself can be utilized to transmit a tilting action transversely of the biaxial plane, if one of the rotors is rigid with the frame except for tilting in the biaxial plane, while the other rotor is transversely pivotal. By applying a transverse tilting force (transverse of the biaxial plane) between the frame and the latter, this tilting force is applied in reverse direction to the transversely-rigid rotor assembly so that tilting forces are applied to the rotors in opposite directions transversely of said biaxial plane. By locating the power plant and operator's seat to locate the centers of gravity of both the machine and operator near a point on the biaxial plane and midway between the rotor axes, neither stability nor distribution of weight is affected by the varying weights of operators. Thus the equipment is substantially balanced about this point since the power plant is located under the operator's seat.

Structural economy is achieved by shaping the main frame to serve also as the rotor guards. The resulting lightness is also desirable for starting the troweling work as soon as possible, and for handling the machine between jobs.

Another feature of simplicity, and especially operational simplicity as to operation of a ride-type machine, is in having the two rotors intermesh through an overlapping zone so that the machine may be moved in the broadside direction, which is therefore conveniently the forward direction, without leaving an unworked zone between its two worked zones. Broadside movement lets both rotors reach the edge of a floor being worked at the same time.

According to another aspect of the invention, with either two-rotor or three-rotor machines, a control system for self-locomotion is provided which is so simple that a neophyte learns in only a few minutes to control the machine movements through all the varying possibilities. This is achieved by a control stick which can be moved about three axes, each perpendicular to one of three mutually perpendicular planes. Movement of the control stick about any one axis causes only one type of locomotion control, leaving the others unaffected. However, the movement can be about two or three axes simultaneously, achieving the combined effects of the two or three types of locomotion. By using linkages such that the operator furnishes, through the control stick and these linkages, the power that applies the tilting forces, maximum simplicity and a reaction "touch" evaluation of the tilting action can be achieved.

The two-rotor machine of this invention can easily be loaded into a truck or the like for transport between jobs. Preferably it is fitted with removable wheels at both ends (with a steering and pulling bar at one end) which aid in such loading and in moving to the precise point of use which cannot be reached by the conveying truck.

We claim:

1. A ride-type surface-working machine including a frame with an operator's seat thereon; a pair of surface-working power-driven rotors having vertical axes lying in a vertical plane perpendicular to the forward facing direction of the seat to be abreast as to motion in that direction, and so spaced apart that the working circles of the two rotors slightly overlap, whereby the machine may be propelled in a direction the operator's seat faces and perpendicular to the biaxial plane of the two rotors without leaving an unworked strip between the working areas.

2. A ride-type surface-working machine including a frame carrying an operator's seat and carried by a pair of surface-working power-driven rotors having generally vertical axes spaced apart to provide a working zone equal in width to approximately their joint diameters; and means for applying tilting forces to said rotors with selective angularity about each rotor to propel the machine by selectively increased traction of the rotors on the work, said means including a transversely pivotal mounting between one of the rotors and the frame lying substantially in the biaxial plane of said rotors and means for applying a tilting force about said pivotal mounting between that rotor and the frame; the other rotor having a mounting to the frame which is transversely rigid with respect to said plane, so that the reaction resulting from applying the tilting force to the transversely pivotable rotor is transmitted through the frame to the rotor having a transversely rigid mounting, whereby rotation of the two rotors in opposite directions will propel the machine approximately along said plane.

3. A ride-type surface-working machine including a frame carrying an operator's seat and carried by a plurality of surface-working rotors carrying said frame and having axes spaced apart to provide mainly separate working areas; means to drive said rotors with two rotors being driven in opposite directions; and control means for selectively applying tilting forces to the rotors to propel the machine by the selectively increased traction resulting from the tilting forces, said control means including a control stick mounted for pivoting about three different axes, each axis being substantially perpendicular to a different one of three mutually perpendicular planes; and tilt control means responsive to the pivoting of the control stick about each of said pivotal axes for applying differently disposed tilting forces to said rotors.

4. A ride-type surface-working machine including a frame carrying an operator's seat and carried by a plurality of surface-working rotors carrying said frame and having axes spaced apart to provide mainly separate working areas; means to drive said rotors with two rotors being driven in opposite directions; and control means for selectively applying tilting forces to the rotors to propel the machine by the selectively increased traction resulting from the tilting forces, said control means including a control stick mounted for pivoting about three different axes, each axis being substantially perpendicular to a different one of three mutually perpendicular planes; and force-transmitting means actuated and powered by the pivoting of said control stick about each one of said pivotal axes for applying tilting forces to the rotors, with varying dispositions of the tilting forces peculiar to the varying movements of the control stick about each of its pivotal axes.

5. A ride-type surface-working machine including a frame carrying an operator's seat and carried by a pair of surface-working power-driven rotors having generally vertical axes spaced apart in a biaxial plane to provide a working zone equal in width to approximately their joint diameters; and means for applying tilting forces to said rotors with selective angularity about each rotor to propel the machine by selectively increased traction of the rotors on the work; said means including a universally pivotal mounting between one of the rotors and the frame and means for applying a tilting force transversely of the biaxial plane between that rotor and the frame; the other rotor having a mounting to the frame which is transversely rigid with respect to said plane so that the reaction resulting from applying the tilting force to the transversely pivotable rotor is transmitted through the frame and the transversely rigid mounting to the rotor thereof, whereby rotation of the two rotors in opposite directions will propel the machine approximately along said plane; said frame including bar means forming a structural part of the frame and lying approximately along and close above the outwardly exposed portions of the peripheries of said working areas, to serve as rotor guards.

6. A ride-type surface-working machine including a frame carrying an operator's seat and carried by a plurality of surface-working power-driven rotors having generally vertical axes spaced apart to provide a wide working zone; and means for applying tilting forces to said rotors with selective angularity about the rotors to propel the machine by selectively increased traction of the rotors on the work, said means including pivotal mountings between the rotors and the frame but providing stable support for the frame; said frame including bar means forming a structural part of the frame and lying approximately along and close above the outwardly exposed portions of the peripheries of said working areas, to serve as rotor guards.

7. A ride-type surface-working machine including a frame carrying an operator's seat and carried by a pair, only, of surface-working rotors having generally vertical axes spaced apart in a biaxial plane to provide a working zone equal in width to approximately their joint diameters; a power plant for driving said rotors; and means for applying tilting forces to said rotors with selective angularity about each rotor to propel the machine by selectively increased traction of the rotors on the work, said means including a universally pivotal mounting between one of the rotors and the frame and means for applying a tilting force transversely of the biaxial plane between that rotor and the frame; the other rotor having a mounting to the frame which is transversely rigid with respect to said plane so that the reaction resulting from applying the tilting force to the transversely pivotable rotor is transmitted through the frame and the transversely rigid mounting to the rotor thereof, whereby rotation of the two rotors in opposite directions will propel the machine approximately along said plane; said power plant and said seat both having gravity centers, including the operator in the case of the seat, approximately in the biaxial plane and approximately centered between the rotor axes so that evenness of weight distribution will not be impaired by differing operator weights.

8. A ride-type surface-working machine including a frame carrying an operator's seat and carried by a pair, only, of surface-working rotors having generally vertical axes spaced apart in a biaxial plane to provide a working zone equal in width to approximately their joint diameters; a power plant for driving said rotors; and means for applying tilting forces to said rotors with selective angularity about each rotor to propel the machine by selectively increased traction of the rotors on the work, said means including a universally pivotal mounting between one of the rotors and means for applying a tilting force about said pivotal mounting; said machine having its center of gravity located near a point in the biaxial plane and midway between said rotor axes, and the operator's seat being positioned to place the operator's center of gravity near said point, so that varying weights of operators will not cause substantial differences of weight distribution.

9. A ride-type surface-working machine including a frame carrying an operator's seat and carried by a plurality of surface-working rotors carrying said frame and having axes spaced apart to provide mainly separate working areas; means to drive said rotors with two rotors being driven in opposite directions; and control means for selectively applying tilting forces to the rotors to propel the machine by the selectively increased traction resulting from the tilting forces, said control means including a control stick mounted for pivoting about three different axes, each axis being substantially perpendicular to a different one of three mutually perpendicular planes; and tilt control means responsive to the pivoting of the control stick about each of said pivotal axes for applying differently disposed tilting forces to said rotors;

said tilt-control means including a separate mechanical means related to each of the three axes and in each case operated by movement about the related axis, but operatively ineffective as to movements about the other two axes.

10. A ride-type surface-working machine including a frame carrying an operator's seat and carried by a plurality of surface-working rotors carrying said frame and having axes spaced apart to provide mainly separate working areas; means to drive said rotors with two rotors being driven in opposite directions; and control means for selectively applying tilting forces to the rotors to propel the machine by the selectively increased traction resulting from the tilting forces, said control means including a control stick mounted for pivoting about three different axes, each axis being substantially perpendicular to a different one of three mutually perpendicular planes; and tilt-control means responsive to the pivoting of the control stick about each of said pivotal axes for applying differently disposed tilting forces to said rotors;

said tilt-control means including a separate mechanical means related to each of the three axes and in each case operated by movement about the related axis, but operatively ineffective as to movements about the other two axes; one of said mechanical means being a link operated by having one end drawn by means pivotable about one of the unrelated axes to be immune to stick movements about that axis, and having its other end pivotal about the other unrelated axis, spaced from the first-named unrelated axis, to be immune to stick movements about it.

* * * * *